United States Patent [19]

Giffen

[11] 3,973,279

[45] Aug. 10, 1976

[54] SINK SHAMPOO UNIT

[76] Inventor: Herbert F. Giffen, 1401 E. Burton, Anaheim, Calif. 92805

[22] Filed: Aug. 22, 1975

[21] Appl. No.: 606,752

[52] U.S. Cl. ..... 4/159

[51] Int. Cl.[2] ..... A47K 3/12; A61H 35/00; A47K 3/03; A47K 3/18

[58] Field of Search ..... 4/159, 185 R, 254, 1

[56] References Cited

UNITED STATES PATENTS

| | | | |
|---|---|---|---|
| 2,451,653 | 10/1948 | Bazalon | 4/159 |
| 2,501,829 | 3/1950 | Rugh | 4/159 |
| 2,521,389 | 9/1950 | McClure | 4/159 |
| 3,026,537 | 3/1962 | Schnell | 4/159 |

*Primary Examiner*—Henry K. Artis

[57] ABSTRACT

A sink shampoo unit that includes a spray head assembly that is removably attachable to a faucet in a sink, and the assembly providing manually operable means for injecting a metered quantity of a liquid shampoo into water discharging from the spray head during the shampooing operation. The spray head assembly when not in use is removably disposed in a container. The container is of such shape that when the spray head assembly is used, the container may serve as a drain board to direct water used in washing the hair back into the sink, when the container is angularly disposed in the latter.

6 Claims, 7 Drawing Figures

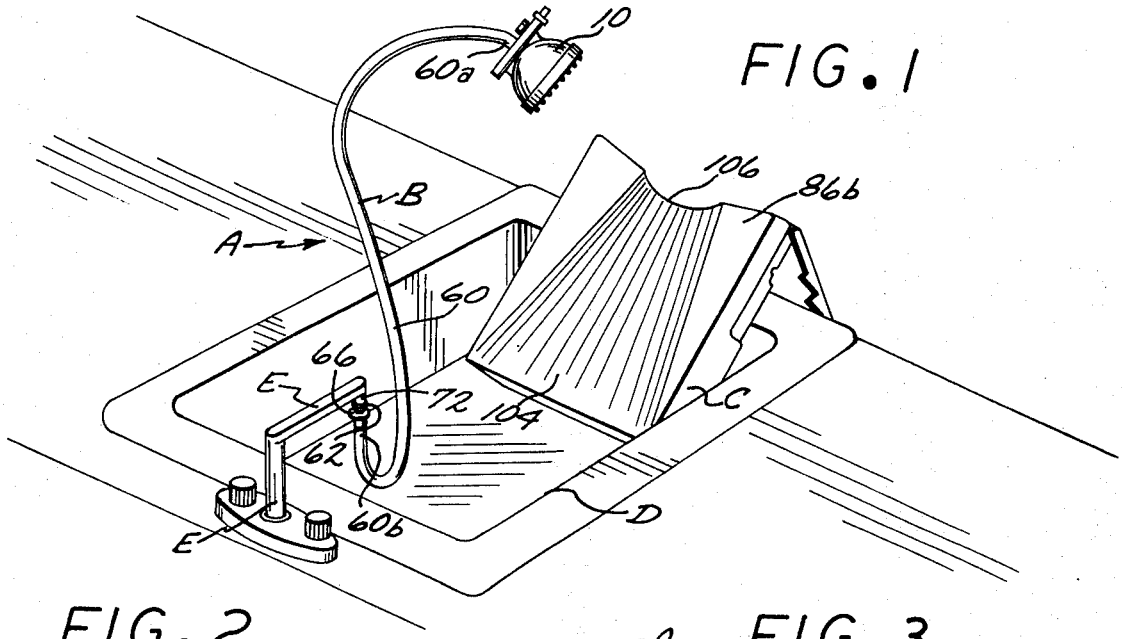
FIG. 1
FIG. 2
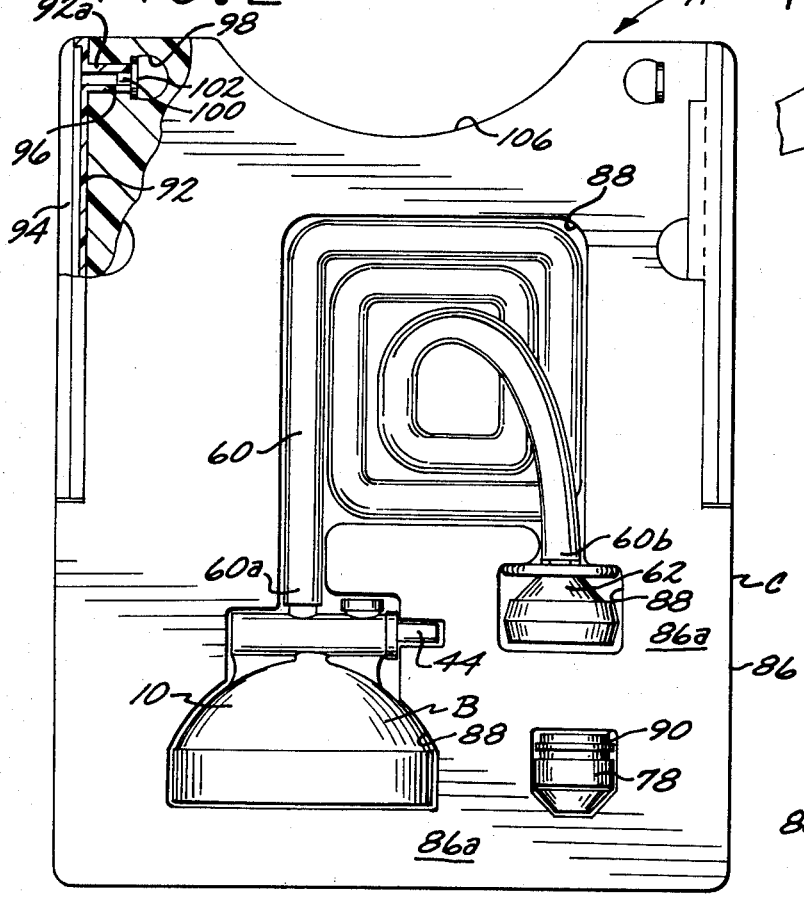
FIG. 3
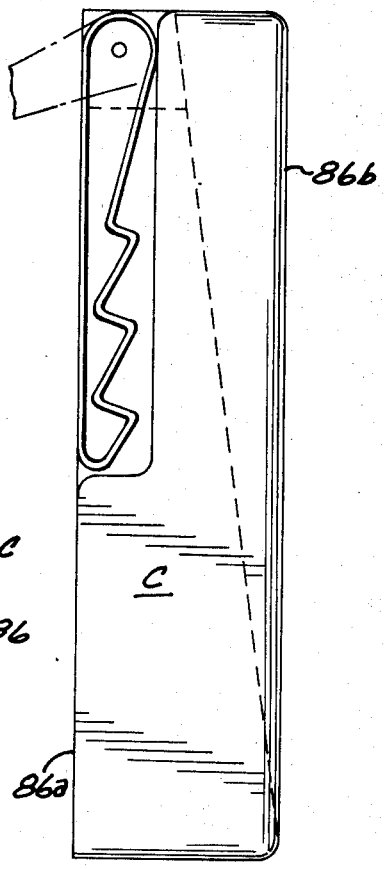

SINK SHAMPOO UNIT

BACKGROUND OF THE INVENTION

1. Field of the Invention

Sink Shampoo Unit.

2. Description of the Prior Art

The shampooing of hair in a sink, without the spilling of water onto the surface areas adjacent the sink, has in the past been difficult to achieve.

The primary object in devising the present invention is to supply a spray head assembly that when not in use is disposed in a container from which it may be easily removed, with the container of such shape that it acts as a drain board to direct washwater from the hair back into the sink when the container is angularly disposed in the latter, and the spray head assembly including manually operable means to inject a metered quantity of liquid shampoo into water discharging from the spray head during the shampooing operation.

Yet another object of the invention is to supply a sink shampoo unit that permits the easy and convenient shampooing of hair in a sink, without water being spilled on the surface areas adjacent the sink as frequently occurs when previously available shampooing units and methods are employed.

SUMMARY OF THE INVENTION

The sink shampoo unit is a combination of a spray head assembly and a container therefor. The container is of such configuration as to serve as a drain board to direct water into a sink in which it is angularly disposed when the spray head assembly is used for shampooing purposes. The spray head of the assembly includes a reservoir for a liquid shampoo, as well as a three-position manually operated valve device. The valve device when in a first position prevents water from discharging from the spray head, and in a second position allows water to discharge from the spray head. Water is supplied to the spray head through a pliable hose that is removably connected to a faucet that is operatively associated with the sink in which the container is angularly disposed to act as a drain board. The valve device when in a third position continues to permit water to discharge from the spray head but concurrently injects a metered quantity of the liquid shampoo thereinto.

BRIEF DESCRIPTION OF THE DRAWINGS

FIG. 1 is a perspective view of the sink shampoo unit in an operative position in a sink;

FIG. 2 is a front elevational view of the sink shampoo unit with the spray head assembly and adaptor removably disposed in a first side of a container;

FIG. 3 is a side elevational view of the container and indicating the manner in which the container defines a drain board surface, as well as the legs that may be angularly disposed to hold the container in the drain board defining configuration as shown in FIG. 1;

DESCRIPTION OF THE PREFERRED EMBODIMENT

The sink shampoo unit A as may best be seen in FIGS. 1, 2 and 3 includes a spray head asssembly B that has a liquid shampoo metering device included as a part thereof, with the spray head assembly capable of being removably disposed in a container C when not in use. The container C, as may be seen in FIG. 1, may be utilized as a drain board to direct wash water from the shampooing operation into a sink D, during the shampooing operation. The sink D is provided with a faucet E.

Figure 6:
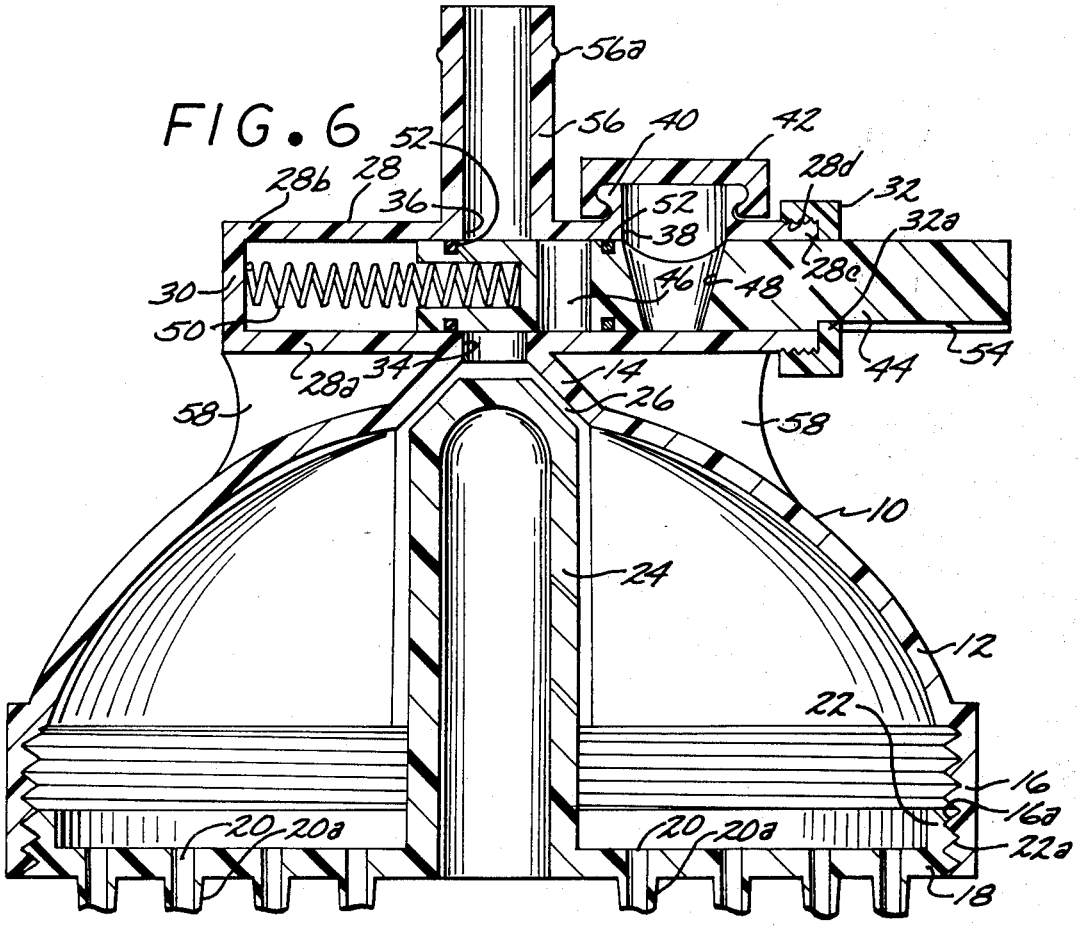
FIG. 6 is a transverse cross sectional view of a spray head and a valve device operatively associated therewith to control the flow of water therethrough, as well as controlling the injection of a metered quantity of liquid shampoo into water discharging from the spray head.

The spray head assembly B includes a spray head 10, best seen in FIG. 6, which spray head includes a semi-spherical shell 12. The shell 12 has a first tubular tapered end 14 and a second end 16 that has threads 16*a* defined thereon.

A circular plate 18 is provided that has a number of spaced apertures 20 formed therein, with each aperture being in communication with an outwardly extending tubular tip 20*a*. The circular plate 18 has a circumferentially extending rib formed thereon, and the ribs having threads 22*a* that are adapted to removably engage the threads 16*a* to hold the plate within the shell 10 as shown in FIG. 6. An elongate pressure regulating member 24 extends upwardly from the plate 18, with the upper extremity of the member capable of being disposed adjacent the interior surface of the first tapered end 14 to define a space 26 therebetween. By rotating the plate 18 the pressure regulating member 24 may be moved upwardly or downwardly relative to the tapered end 14 to vary the width of the space 26 therebetween. As the width of the space 26 is varied, the pressure on water entering the spray head 10 is controlled.

A transverse valve housing 28 is provided and is adjacently disposed to the first tubular tapered end 14 as best seen in FIG. 6. The housing 28 includes a cylindrical shell 28*a* that has a first end 28*b* and second end 28*c*. Threads 28*d* are formed on the exterior surface of the second end portion 28*c*. An end piece 30 closes the first end 28*b* as may be seen in FIG. 6. An internally threaded cap 32 is provided that engages the threads 28*d* on the second end portion 28*c*. The cap has an inwardly projecting lug 32*a* formed thereon, the purpose of which will later be explained.

First and second openings 34 and 36 are formed in the cylindrical shell 28*a*. A third opening 38 is also formed in the shell and is in communication with a liquid shampoo reservoir 40, which reservoir is removably closed by a resilient cap 42 that is in engagement therewith.

Figure 4:
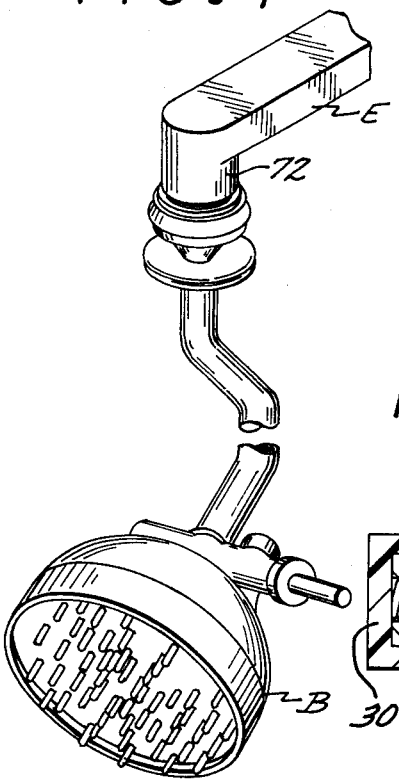
FIG. 4 is a perspective view of the spray head assembly removably secured to a faucet.
Figure 5:
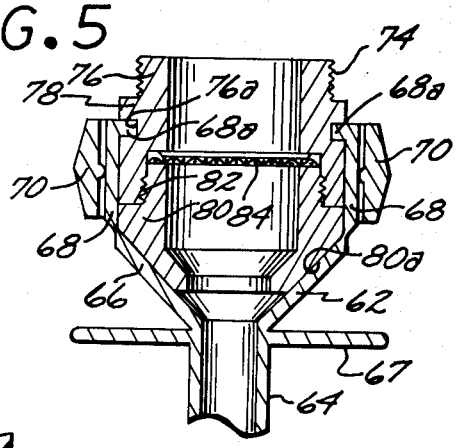
FIG. 5 is a fragmentary longitudinal cross sectional view of an adaptor that may be removably secured to a faucet; and the adaptor capable of having a connector removably secured thereto, which connector is in communication with a pliable hose.
Figure 7:
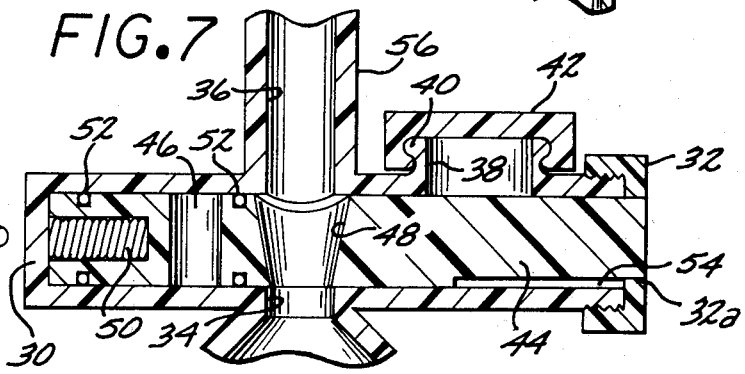
FIG. 7 is the same view as shown in the upper portion of FIG. 6, but with the valve device being moved to the left to a position where a metered quantity of liquid shampoo is injected into water that will discharge from the spray head.

An elongate valve member 44 is slidably mounted within the confines of the valve housing 28 and this valve member having a transverse passage 46 therein as well as a liquid shampoo metering passage 48. A compressed helical spring is longitudinally disposed in the valve housing 28, with one end of the spring being in contact with the end piece 30 and the other end in abutting contact with the valve member 44. The valve member 44 has a longitudinally extending groove 54 formed on the right hand end portion thereof as viewed in FIG. 6, with this groove engaging the lug 32*a* to prevent the valve member 44 rotating within the cylindrical shell 28*a*. Non-rotation of the valve member 44 is necessary to maintain the liquid shampoo metering passage 48 in alignment with the shampoo reservoir 40 when the valve member 44 is in the first position illustrated in FIG. 6. If the valve member 44 is of non-circular transverse cross section, the valve member will not rotate in the housing 28 and the lug 32*a* and groove 54 may be eliminated. A tubular water inlet 56 is provided that is secured to housing shell 28*a* and extends outwardly therefrom and in communication with the second opening 36. The outer extremity of the tubular water inlet 56 has a circumferentially extending rib 56*a* formed thereon. Two axially aligned reinforcing webs 58 are provided that extend between the upper portion of the spray head shell 12 as may be seen in FIG. 6 and the under portion of the housing shell 28*a*. A pliable hose 60 is provided that has a first end portion 60*a* that slips over the outer extremity of the tubular water inlet 56 to frictionally engage the rib 56*a* thereon. The hose also includes a second end portion 60*b*. A connector 62 is provided that is preferably moulded from a suitable polymerized resin, and the connector including a tubular member 64 that slips into the interior of the second end portion 60*b* of the hose 60 and is removably held in place therein. Tubular member 64, as can be seen in FIG. 5, has a circular plate 67 extending outwardly therefrom. The tubular member 64, as can be seen in FIG. 5, develops into a conical extension 66 that has legs 68 pivotally secured to the upper extremities thereof, preferably by living hinges. The legs 68 on the upper extremities thereof, as may be seen in FIG. 5, have inwardly extending lugs 68*a* formed as a part thereof. The legs 68, as may also be seen in FIG. 5, are adapted to be engaged by a slip ring 70.

The faucet E, as is conventional with such devices, has a downwardly extending tubular portion that has internal threads (not shown) formed therein, and these threads being engageable by threads 74 formed on a first portion 76 of a tubular adaptor 78 as shown in FIG. 5. A second portion 80 of adaptor 78 has threads 82 formed thereon which also engage threads 82 formed on the first portion 76. The first and second portions 76 and 80 of the adaptor 78 cooperate to removably support a filter 84 therebetween as shown in FIG. 5. The second portion 80 has a conical surface 80*a* defined thereon, which conical surface is in abutting contact with the interior surface of a conical extension 67 when the slip ring 70 is moved upwardly to force the lugs 68*a* into a circumferential groove 76*a* formed on the first portion 76 of the adaptor 78.

The container C is preferably formed from a substantially rectangular block 86 of a light weight material, such as a foamed resin, that has a water impervious exterior surface, and the block having a first side 86*a* and a second side 86*b* as shown in FIGS. 2 and 3. The first side 86*a* has a first recess 88 therein of such shape as to removably accommodate the spray head assembly B when it is disposed in the cavity as shown in FIG. 2. The first side 86*a* also has a second recess 90 formed therein of such size as to accommodate the adaptor 78. A pair of laterally spaced legs 92 are provided that have tubular members 92*a* that extend outwardly from the upper ends thereof as the legs are viewed in FIG. 2, with these tubular members being rotatably supported in bores 96 formed in the block 86. When the legs are disposed, as shown in solid line in FIGS. 2 and 3, the legs are situated in a pair of recesses 94 that extend along the sides of the block. The tubular members 92*a* are rotatably supported in bores 96 that extend inwardly from the side of the block 86 and on their inner extremities develop into cavities 98, best seen in FIG. 2. The free ends of the tubular members 92*a* are removably engaged by short rods 100 that have heads 102 thereon that serve as stops to prevent the legs being inadvertently displaced from the bores 96. The heads 102 are removably situated within the confines of the cavities 98.

The second side 86*b* of the block 86 has a longitudinally extending channel 104 formed therein as can best be seen in FIG. 1, that directs wash water from the hair during the shampooing operation that falls on the channel back into the sink D, and as a result the areas around the sink are not wet with water during the shampooing operation. A concavity 106 is formed in the upper edge portion of the block 86 to abut against the neck of a user (not shown) during the shampooing operation. The legs 92, as may best be seen in FIGS. 1 and 3, have a series of steps 92*b* formed therein to assist in supporting the block C in the wash water receiving position illustrated during the shampooing operation.

The use and operation of the invention is extremely simple. The spray assembly B together with the tubular adaptor 78 will be situated within the recesses formed in the first side 86*a* of the container C when the invention is not in use for shampoo purposes. When it is desired to use the invention A for shampoo purposes, the spray head assembly B is removed from the container C.

The first portion 76 of the adaptor 78 will previously have been secured to the downwardly extending outlet 72 of the faucet E. After removal of the spray head assembly from the container C, the slip ring 70 is moved downwardly and the legs 68 pivoted outwardly and then inwardly for the lugs 68*a* to engage the groove 76*a*. The slip ring 70 is now moved upwardly to the position shown in FIG. 5. When the slip ring is so disposed, the hose 60 is in communicaton with the faucet E which faucet may then be placed in the open condition. Flow of water from the faucet E through the spray head assembly B is controlled by use of the valve member 44. The valve member when in the first position shown in FIG. 6 obstructs communication between the tubular water inlet 56 and the apertures 20. The compressed spring 50 at all times tends to move the valve member 44 to the first position, and the valve member assuming this first position due to the lugs 32*a* acting as a stop when the inner extremity of the groove 54 is in abutting contact with the lug as shown in FIG. 6. When it is desired to discharge water from the apertures 20 and the tubular tips 20*a*, the valve member 44 is moved to a second position where the passage 46 is axially aligned with the interior of the tubular water inlet 56. Water now discharges through the passage 46 and space 26 into the interior of the spray head shell 12, and the pressure at which the water discharges into the interior of the shell being controlled by the elongate pressure regulator member 24 as previously explained. Prior to the spray head assembly B being used, the reservoir 40 has been filled with liquid shampoo. When it is desired to discharge a metered quantity of the liquid shampoo into the water discharging from the apertures 20, the valve member 44 is moved to a third position, where the liquid shampoo metering passage 48 is axially aligned with the interior of a tubular water inlet 56. If one metered quantity of liquid shampoo is not sufficient, the operation may be repeated to inject a second metered quantity of the liquid shampoo into the stream of water discharging into the interior of the shell 12. Before the spray head assembly B has been disposed as above described, the legs 92 are pivoted outwardly from the container C to the position shown in FIG. 1, where the legs are utilized to support the container C with the second surface facing upwardly, and the channel 106 then acting to direct wash water from the shampooing operation downwardly into the sink. After the shampooing operation has been completed, the series of steps above described are reversed, with the legs 92 being pivoted into the recesses 94, and the spray head assembly B disconnecting adaptor 78 by moving the slip ring 70 downwardly to permit the legs 68 to be pivoted outwardly to disengage the lugs 68*a* from the groove 76*a*. The adaptor 78 may be unscrewed from the faucet E, and placed in the recess 90 as shown in FIG. 2. The spray head assembly B is likewise placed in the recess 88 of a container as shown in FIG. 2, where it will remain until again needed.

Although the spray head assembly B may be formed from any suitable water impervious material, as may the container C, it is recommended that these elements be formed from a polymerized resin, as such a material is both light in weight, durable, water impervious, and requires little or no maintenance attention.

The use and operation of the invention has been explained previously in detail and need not be repeated.

I claim:

1. A sink shampoo unit that includes a portable spray head assembly and container thereof, said container serving to removably hold said spray head assembly when the latter is not in use and as a drain board that is removably disposed at an angle in a sink to direct water into said sink when said spray head assembly is used for a shampoo by being connected to a faucet operatively associated with said sink, said combination including:

a. a spray head having a water inlet and a plurality of spaced water outlets;

b. a reservoir for a liquid cleanser on said spray head;

c. spring loaded manually operated valve means on said spray head that is normally in a first position to obstruct communication between said inlet and outlets, said valve means including a movable metering chamber that is in communication with said reservoir when said valve means is in said first position, said valve means when in a second position establishing communication between said inlet and said outlets, and said valve means when in a third position establishing communication between said inlet and said outlets and injecting a metered quantity of said liquid cleanser from said metering chamber into water as the latter flows through said spray head to discharge as a spray from said outlets;

d. a pliable hose having first and second ends, said first end connected to said water inlet on said spray head;

e. first means on said second end of said hose for removably connecting said hose to said faucet;

f. a container in the form of a substantially rectangular body that has first and second oppositely disposed sides, a plurality of spaced recesses in said first side in which said spray head, hose and first means are contained when not in use, and a longitudinal channel formed in said second side; and g. pivotally supported leg means on said container for holding the latter in an inclined position on said sink, with said second side facing upwardly for said channel to direct water discharged from said spray head downwardly into said sink after said spray head, hose and first means are removed from said cavities to have said first means connected to said faucet and said spray head used for shampoo purposes on the hair of the head of a user when said hair and head are disposed above said inclined second side.

2. The combination as defined in claim 1 wherein said spray head includes:

h. a semi-spherical shell on which said water inlet is provided, and with said shell having an open end on which threads are defined;

i. a circular plate having threads on the periphery thereof which engage said threads on said shell, which plate has a plurality of apertures formed therein that define said water outlets; and j. an elongate member mounted on said plate that is in alignment with said inlet, with said plate as it is rotatably adjusted on said shell varying the width of the space between the free extremity of said elongate member and that portion of said shell adjacent said water inlet, with the width of said space controlling the pressure of water within said shell and the force with which said water flows from said water outlets as jets.

3. The combination as defined in claim 2 wherein said spring-loaded manually operated valve means includes:

k. an elongate transverse valve housing formed as an integral part of said shell, said housing having said reservoir supported therefrom, which valve housing has first and second axially aligned openings formed therein, said first opening serving as said water inlet to said semi-cylindrical shell and said second opening in communicaton with said hose;

l. an elongate valve member slidably disposed in said housing, which valve member has a first transverse passage formed therein and a second passage longitudinally spaced from said first passage, said second passage being axially aligned with said reservoir when said valve member is in a first position, and said second passage serving as a metering chamber for liquid shampoo from said reservoir;

m. stop means that prevent said valve member from moving beyond said first position; and n. a compressed helical spring in said housing that at all times tends to maintain said valve member in a first position where it obstructs the flow of water between said first and second openings in said housing with said valve member being adapted to be manually moved to a second position where said first passage is in axial alignment with said first and second openings to permit water to flow from said hose to the interior of said semi-spherical shell to discharge through said apertures in said plate, and with said valve member being adapted to be moved to a third position where said second passage filled with a metered quantity of shampoo and is axially aligned with said first and second openings to permit continued flow of water therebetween and to inject said metered quantity of liquid shampoo therein.

4. The combination as defined in claim 3 wherein said reservoir is mounted on said housing and in communication with said second transverse passage when said valve member is in said first position.

5. The combination as defined in claim 3 wherein said first means includes:

o. an adapter removably secured to said faucet; and p. a connector mounted on said second end of said hose that can removably engage said adapter.

6. The combination as defined in claim 5 wherein said adapter has a circumferentially extending groove and said connector includes a plurality of circumferentially spaced pivotally movable lug-supporting legs, and a slip ring that may be moved relative to said legs to force said lugs into said groove to removably connect said connector to said adapter.

* * * * *